US007460175B2

(12) United States Patent
Young et al.

(10) Patent No.: US 7,460,175 B2
(45) Date of Patent: Dec. 2, 2008

(54) SUPERSAMPLING OF DIGITAL VIDEO OUTPUT FOR MULTIPLE ANALOG DISPLAY FORMATS

(75) Inventors: Wayne D. Young, Milpitas, CA (US); Michael A. Ogrinc, San Francisco, CA (US)

(73) Assignee: Nvidia Corporation, Santa Clara, CA (US)

( * ) Notice: Subject to any disclaimer, the term of this patent is extended or adjusted under 35 U.S.C. 154(b) by 517 days.

(21) Appl. No.: 10/817,392

(22) Filed: Apr. 2, 2004

(65) Prior Publication Data

US 2005/0219415 A1 Oct. 6, 2005

(51) Int. Cl.
*G09G 5/02* (2006.01)

(52) U.S. Cl. ..... 348/554; 348/555; 348/441

(58) Field of Classification Search ..... 348/554, 348/552–553, 555, 441, 556, 558, 705–706; 345/154, 520, 557; *G09G 5/02*
See application file for complete search history.

(56) References Cited

U.S. PATENT DOCUMENTS 4,339,774 A 7/1982 Temple
6,327,000 B1 * 12/2001 Auld et al. ..... 348/441
6,327,002 B1 * 12/2001 Rinaldi et al. ..... 348/554
6,456,340 B1 * 9/2002 Margulis ..... 348/745
6,885,378 B1 * 4/2005 Tsai et al. ..... 345/557
7,102,645 B2 * 9/2006 Chow ..... 345/520

OTHER PUBLICATIONS

Zoran Corporation, CVE4 Progressive Output Video Encoder Product Brief, pp. 1-2 http://www.zoran.com/products/ip_cores/video_encoders/cve4.html (Zoran Corporation, Sunnyvale, CA (US)).

* cited by examiner

*Primary Examiner*—Trang U Tran
(74) *Attorney, Agent, or Firm*—Townsend and Townsend and Crew LLP

(57) ABSTRACT

An output pipeline for a video processing device provides supersampling of the output data the digital domain to eliminate or reduce unwanted frequency components in an analog output signal. An encoder converts a pixel stream to digital sample values for a target analog signal at a base sampling rate. The base data stream is supersampled, and the supersampled data is provided to a digital to analog converter The supersampling rate can be selected so as to provide substantial attenuation of a higher frequency echo in the analog output signal.

22 Claims, 5 Drawing Sheets

SUPERSAMPLING OF DIGITAL VIDEO OUTPUT FOR MULTIPLE ANALOG DISPLAY FORMATS

BACKGROUND OF THE INVENTION

The present invention relates in general to video processing devices, and in particular to supersampling of digital video output for multiple analog display formats.

Many display devices in use today generate images by coloring each of an array of pixels in accordance with an analog input signal that sequentially specifies the color of each pixel. The analog input signal is generally provided in a format specified by a transmission protocol associated with the device. A number of signal formats are in use today, including "standard definition" television (SDTV) formats such as NTSC (National Television Standards Committee) or PAL (Phase Alternating Line); high definition television (HDTV) formats such as 720p, 1080i or 1080p; and VGA or similar formats for computer monitors. Transmission protocols or signal formats, which are usually defined by some standards body or industry consortium, specify parameters such as the frame rate, the number of lines per frame, the number of pixels per line, the meaning of signal amplitude and/or phase, and similar parameters. For example, the NTSC protocol specifies a data rate 525 lines per frame and about 30 frames, interlaced, per second. It also specifies a relationship between (analog) signal amplitude and pixel intensity and, in the case of color images, between signal phase and pixel hue. Such specifications establish a bandpass and other characteristics of the analog signals that a video data source should provide.

In general, different protocols specify different signal formats, and display devices are usually designed for a single format. Thus, makers of video processing devices and other video data sources are confronted with the challenge of providing video signals for a number of different (and sometimes still evolving) formats.

One solution is to provide a different video processing device for each different format. This, however, makes it harder for the end user to upgrade one component of a system, e.g., replacing an SDTV display device with an HDTV, because any incompatible video processing devices (video game consoles, DVD players, etc.) would also have to be replaced. It also requires the manufacturer to design and build a number of different devices with different internal architectures, adding overhead.

Another, more common, solution is to provide a video processing device that has different output processing paths for some number of different standards. For example, FIG. 1 shows block diagrams for conventional output paths of a video card capable of providing data to an SDTV display and a computer monitor. FIG. 1A shows a separate processing path for each type of device. The TV path 102 includes a pixel pipeline 104 that supplies digital pixel data (e.g., RGB color components); an encoder 106 that converts the pixel data to samples of an analog signal for the TV (e.g., in NTSC format); a digital to analog converter (DAC) 108; and a reconstruction filter 110, which generally includes a low-pass filter combined with one or more correction elements (e.g., a sin (x)/x correction) that is designed to reduce artifacts in the analog signal resulting from DAC 108 and the low-pass filter section of recon filter 110. The monitor path 120 includes a pixel pipeline 122; an encoder 124; a DAC 126; and an electromagnetic interference (EMI) filter 128, which is simply a low-pass filter with a frequency cut off above about 200 MHz. Such filters are commonly provided to limit the high frequency radiation emitted by electronic devices (e.g., in compliance with Federal Communications Commission (FCC) regulations in the United States). The arrangement of FIG. 1A entails duplication of numerous components, including the pixel pipeline, the encoder, and the DAC. This duplication wastes card or chip area and complicates the designer's task.

FIG. 1B shows an alternative conventional design in which some elements common to both processing paths can be combined. Thus, there is just one pixel pipeline 132, one encoder 134 (which may be configurable for different analog formats) and one DAC 136. Analog switch 138 is provided to direct the signal to either a reconstruction filter 140 of a TV path or an EMI filter 142 of a monitor path. While this arrangement reduces duplication of components, analog switch 138 introduces additional complexity to the design and can result in loss of signal integrity. In addition, to modify the card to support a third output format, it would generally be necessary to provide a three-way analog switch and additional filters appropriate to the third format. This would require at least some redesign and limits the number of display devices that a single video processing card can be adapted to drive.

It would therefore be desirable to provide an improved video data source that supports multiple standards and can easily be reconfigured for different standards.

BRIEF SUMMARY OF THE INVENTION

Embodiments of the present invention provide an output pipeline for a video processing device in which the output data is supersampled in the digital domain to eliminate or reduce unwanted frequency components in an analog output signal. In some embodiments, this supersampling reduces or eliminates the need for format-specific analog filtering circuitry, allowing the output pipeline to be more easily reconfigured for different output formats. In some embodiments, the output pipeline can be reconfigured to provide different output formats.

According to one aspect of the present invention, a device for converting a digital pixel signal to an analog output signal having a target format includes a pixel pipeline circuit, an encoder, a supersampling circuit, and a digital to analog converter. The pixel pipeline circuit is configured to provide a pixel stream including digital pixel values. The encoder is coupled to an output of the pixel pipeline circuit and is configured to convert the pixel stream to digital sample values for a target analog signal representing the pixel stream in the target format, thereby generating a base data stream at a base sampling rate. The supersampling circuit is coupled to an output of the encoder and is configured to generate a supersampled data stream at a supersampling rate from the base data stream, the supersampling rate being higher than the base sampling rate. The digital to analog converter is coupled to an output of the supersampling circuit and is configured to convert the supersampled data stream to an analog output signal. In some embodiments, the supersampling rate is selected so as to provide substantial attenuation of a higher frequency echo in the analog output signal, the higher frequency echo occurring in a frequency band above a baseband of the analog output signal. In some embodiments, the device may also include an electromagnetic interference (EMI) filter coupled to an output of the digital to analog converter and configured to substantially attenuate frequency components of the analog output signal above a maximum frequency.

In some embodiments the encoder may be further configured to respond to one or more control parameters, thereby enabling selection of one of a number of candidate formats as the target format. The candidate formats may include, for example, a standard definition television format and a high definition television format.

According to another aspect of the present invention, a device for converting a digital pixel signal to an analog output signal having a target format includes a pixel pipeline circuit, a supersampling circuit, an encoder, and a digital to analog converter. The pixel pipeline circuit is configured to provide a pixel stream including a first number of digital pixel values per line at a base pixel rate. The supersampling circuit is coupled to an output of the pixel pipeline circuit and is configured to generate a supersampled pixel stream including a second number of digital pixel values per line, the second number being greater than the first number, at a supersampling rate higher than the base pixel rate. The encoder is coupled to an output of the supersampling circuit and is configured to convert the supersampled pixel stream to digital sample values for a target analog signal representing the supersampled pixel stream in the target format, thereby generating a supersampled data stream at an enhanced sampling rate. The digital to analog converter is coupled to an output of the encoder and is configured to convert the supersampled data stream to an analog output signal. The supersampling rate may be selected so as to provide substantial attenuation of a higher frequency echo of the analog output signal, the higher frequency echo occurring in a frequency band above a baseband of the analog output signal.

According to yet another aspect of the present invention, a video processing unit includes a pixel generator circuit, a pixel pipeline, an encoder, a supersampling circuit, and a digital to analog converter. The pixel generator circuit is configured to generate and store pixel data for a frame of an image. The pixel pipeline is configured to retrieve the stored pixel data and to provide a pixel stream including digital pixel values at a base pixel rate. The encoder is coupled to an output of the pixel pipeline circuit and is configured to convert the pixel stream to digital sample values for a target analog signal representing the pixel stream in a target format, thereby generating a base data stream at a base sampling rate. The supersampling circuit is coupled to an output of the encoder circuit and is configured to generate a supersampled data stream at a supersampling rate from the base data stream, the supersampling rate being higher than the base sampling rate. The digital to analog converter is coupled to an output of the supersampling circuit and is configured to convert the supersampled data stream to an analog output signal. The supersampling rate of the supersampled data stream is selected so as to provide substantial attenuation of a higher frequency echo in the analog output signal, the higher frequency echo occurring in a frequency band above a baseband of the analog output signal.

According to still another aspect of the present invention, a method for converting a digital pixel signal to an analog output signal having a target format is provided. A pixel stream including digital pixel values is received. The pixel stream is encoded as a base data stream including digital sample values for a corresponding analog signal having the target format, where the encoding is performed at a base sampling rate. The base data stream is supersampled at a supersampling rate, the supersampling rate being higher than the base sampling rate, thereby generating a supersampled data stream. The supersampled data stream is converted to an analog output signal. The supersampling rate is selected so as to provide substantial attenuation of a higher frequency echo in the analog output signal, the higher frequency echo occurring in a frequency band above a baseband of the analog output signal. In some embodiments, the target format may be selected from a plurality of candidate formats, which may include, e.g., a standard definition television format and a high definition television format.

The following detailed description together with the accompanying drawings will provide a better understanding of the nature and advantages of the present invention.

DETAILED DESCRIPTION OF THE INVENTION

Embodiments of the present invention provide an output pipeline for a video processing device in which the output data is supersampled in the digital domain to eliminate or reduce unwanted frequency components in the analog output signal. In some embodiments, supersampling reduces or eliminates the need for format-specific analog filtering circuitry, allowing the output pipeline to be more easily reconfigured for different output formats. In some embodiments, the output pipeline can be used to provide multiple output formats in parallel; in other embodiments, the pipeline can be reconfigured to provide a different output format. The present invention can be implemented in a wide range of video processing devices, including graphics or video processors for general purpose computer systems, special purpose computer systems such as video game consoles, and other digital video devices such as DVD players or the like.

Figure 2:
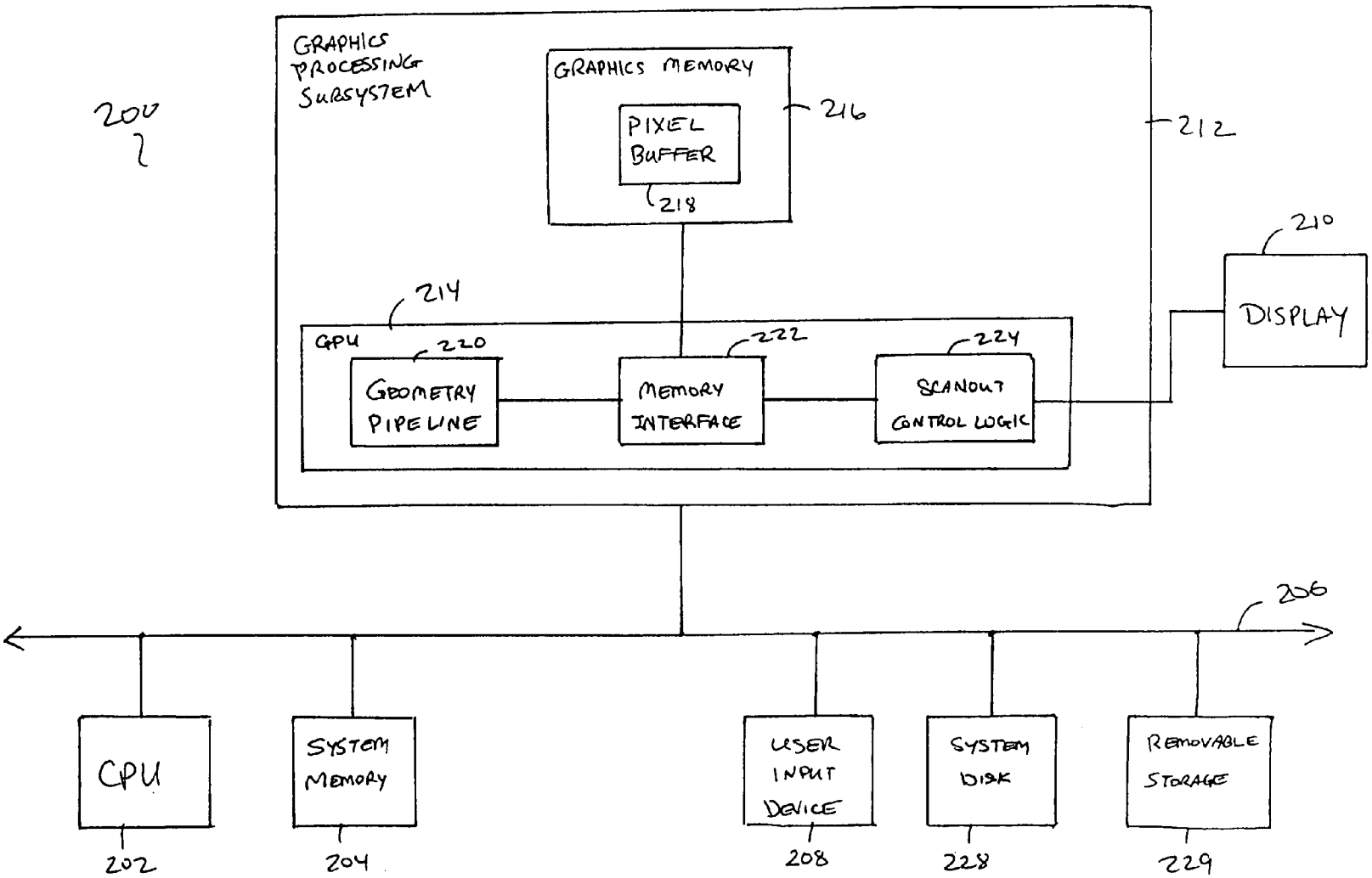
FIG. 2 is a high level block diagram of a computer system according to an embodiment of the present invention.

FIG. 2 is a block diagram of a computer system 200 according to an embodiment of the present invention. Computer system 200 includes a central processing unit (CPU) 202 and a system memory 204 communicating via a bus 206. User input is received from one or more user input devices 208 (e.g., keyboard, mouse) coupled to bus 206. Visual output is provided on a pixel based display device 210 (e.g., a conventional CRT or LCD based monitor) operating under control of a graphics processing subsystem 212 coupled to system bus 206. A system disk 228 and other components, such as one or more removable storage devices 229 (e.g., floppy disk drive, compact disk (CD) drive, and/or DVD drive), may also be coupled to system bus 206. System bus 206 may be implemented using one or more of various bus protocols including PCI (Peripheral Component Interconnect), AGP (Accelerated Graphics Port) and/or PCI Express (PCI E); appropriate "bridge" chips such as a conventional north bridge and south bridge (not shown) may be provided to interconnect various components and/or buses.

Graphics processing subsystem 212 includes a graphics processing unit (GPU) 214 and a graphics memory 216, which may be implemented, e.g., using one or more integrated circuit devices such as programmable processors, application specific integrated circuits (ASICs), and memory devices. Graphics memory 216 includes a pixel buffer 218 that stores color data for an array of display pixels. GPU 214 includes a geometry processing pipeline 220, a memory interface module 222, and scanout control logic 224. Geometry processing pipeline 220 may be configured to perform various tasks related to generating pixel data from graphics data supplied via system bus 206 (e.g., implementing various 2D and or 3D rendering algorithms), interacting with graphics memory 216 to store and update pixel data, and the like. Memory interface module 222, which communicates with geometry pipeline 220 and scanout control logic 224, manages all interactions with graphics memory 216. Memory interface module 222 may also include pathways for writing pixel data received from system bus 206 to pixel buffer 218 without processing by geometry pipeline 220. The particular configuration of geometry processing pipeline 220 and memory interface module 222 may be varied as desired, and a detailed description is omitted as not being critical to understanding the present invention.

As mentioned above, pixel buffer 218 stores color data for an array of display pixels. In some embodiments, the color data for a pixel includes separate red (R), green (G), and blue (B) color intensity values, each represented using a number (e.g., 8) of bits. Pixel buffer 218 may also store other data, such as depth (Z) and/or transparency data for some or all pixels. In some embodiments, pixel buffer 218 may store more than one set of RGB color values per pixel, and the color values may be combined, or downfiltered, prior to or during scanout operation. It is to be understood that GPU 214 may be operated in any manner that results in pixel data being stored in pixel buffer 218.

Scanout module 224, which may be integrated in a single chip with GPU 214 or implemented in a separate chip, reads pixel color data from pixel buffer 218 and transfers the data to display device 210 to be displayed. In one embodiment, scanout occurs at a constant screen refresh rate (e.g., 80 Hz); the refresh rate can be a user selectable parameter, or it can be determined based on the display format in use (e.g., about 30 Hz for NTSC). The scanout order may be varied as appropriate to the display format (e.g., interlaced or progressive scan). Scanout module 224 may also perform other operations, such as adjusting color values for particular display hardware; and/or generating composite screen images by combining the pixel data from pixel buffer 218 with data for a video or cursor overlay image or the like, which may be obtained, e.g., from graphics memory 216, system memory 204, or another data source (not shown).

In accordance with an embodiment of the present invention, scanout module 224 includes conversion circuitry that converts the pixel data from digital format to analog format for displaying on display device 210. As described below, the conversion circuitry is adaptable to different display device protocols; accordingly many types of display devices 210 can be supported, including SDTV displays using NTSC, PAL or other formats; HDTV displays using various HD formats; CRT or LCD computer monitors, and so on.

It will be appreciated that the system described herein is illustrative and that variations and modifications are possible. A GPU may be implemented using any suitable technologies, e.g., as one or more integrated circuit devices. The GPU may be mounted on an expansion card that may include one or more such processors, mounted directly on a system motherboard, or integrated into a system chipset component (e.g., into the north bridge chip of one commonly used PC system architecture). The graphics processing subsystem may include any amount of dedicated graphics memory (some implementations may have no dedicated graphics memory) and may use system memory and dedicated graphics memory in any combination. In particular, the pixel buffer may be implemented in dedicated graphics memory or system memory as desired. The scanout circuitry may be integrated with a GPU or provided on a separate chip and may be implemented, e.g., using one or more ASICs, programmable processor elements, other integrated circuit technologies, or any combination thereof. In addition, the GPU may be incorporated into a variety of devices, including general purpose computer systems, video game consoles and other special purpose computer systems, DVD players, and the like.

Figure 3:
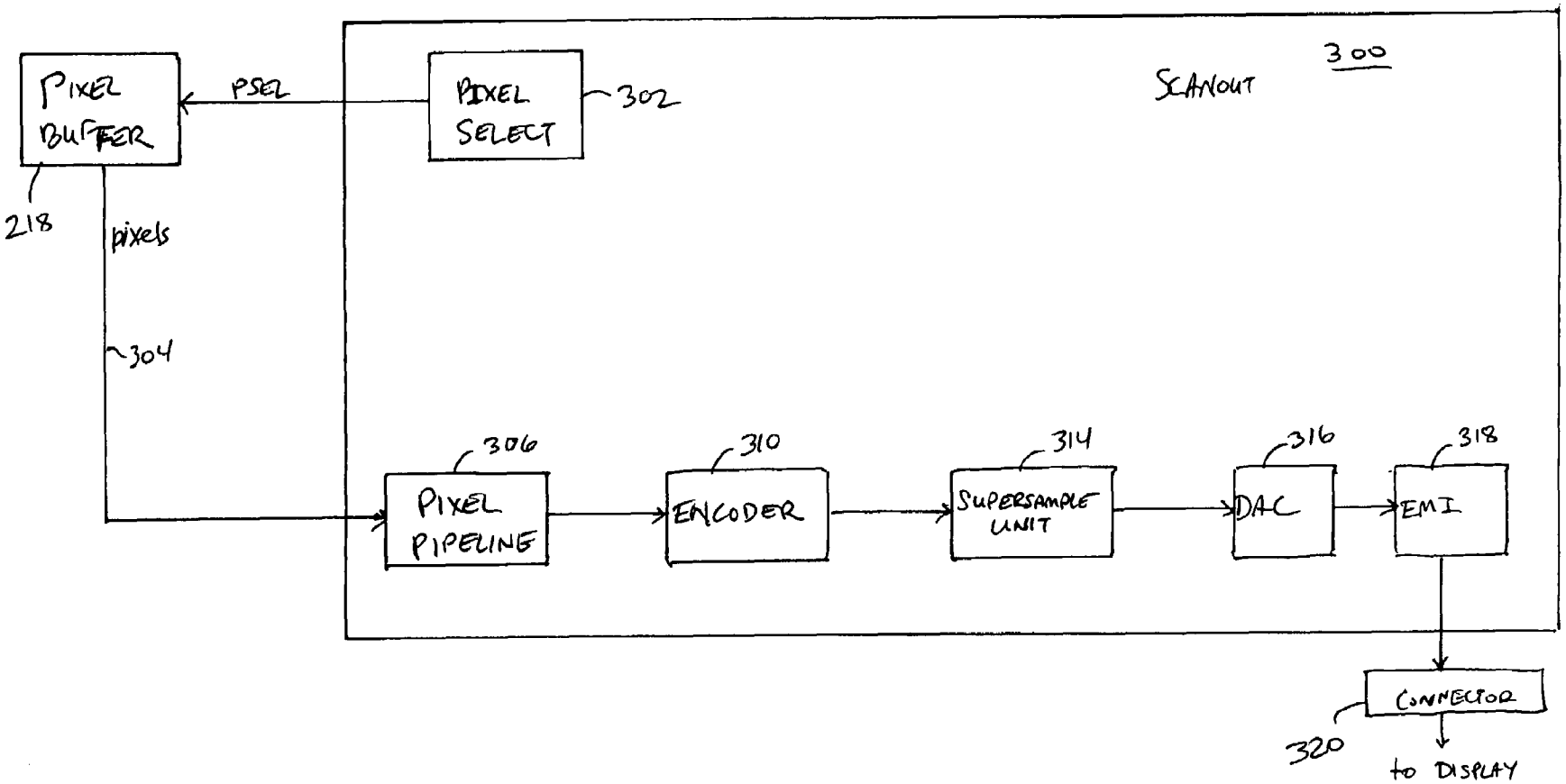
FIG. 3 is a block diagram of a scanout module according to an embodiment of the present invention.

FIG. 3 is a block diagram showing more detail of a scanout module 300 according to an embodiment of the present invention. Pixel select block 302, which may be of generally conventional design, selects a current pixel (e.g., by scanning across lines of pixels in a raster array, with the current pixel being incremented according to a pixel clock signal) and generates a pixel select signal (PSEL) for pixel buffer 218. This signal causes the color value for the selected pixel (represented, e.g., as RGB components) to be transmitted to scanout module 300 via signal line(s) 304. Scanout module 300 may include a pixel pipeline 306 having one or more stages configured to perform various transformations on the pixels. Numerous examples of such transformations are known in the art, such as composition of images using overlays, rescaling of image size, visible area selection, downfiltering, dithering, and the like.

After any transformations in pixel pipeline 306, a stream of pixel data is provided in digital form (e.g., as RGB color components) to an encoder 310. The pixel stream is advantageously provided to encoder 310 at a substantially constant pixel rate, although there may be blanking periods or other interruptions, e.g., corresponding to horizontal and/or vertical retrace intervals specified by a target display protocol.

Encoder 310 transforms the pixel data to a stream of digital sample values modeling a target analog signal that advantageously conforms to a display device protocol for a target device. Encoder 310 advantageously generates samples at a substantially constant base sampling rate. In some instances, the base sampling rate may be specified by the display device protocol; in other instances, the base sampling rate may be selected according to standard rules of sampling theory, e.g., based on spectral analysis of characteristic analog signals for a particular target format.

For example, if the target format is NTSC, encoder 310 would be configured to compute appropriate amplitude and/or phase values for each pixel and generate samples of the resulting waveform at a base sampling rate of around 54 million samples per second (MS/s). In some embodiments, encoder 310 may be configurable to generate samples conforming to different protocols; for example, a CVE4 video encoder supplied by Zoran Corp. of Sunnyvale, Calif., that can support a number of different display protocols may be used. Encoding techniques for various protocols are known in the art, and a detailed description is omitted as not being critical to understanding the present invention.

The data stream from encoder 310 is provided to a supersampling (or upsampling) unit 314. Supersampling unit 314 increases the number of samples per display line by generating additional samples that are intermediate between the samples received from encoder 310. In some embodiments, supersampling unit 314 may include a conventional interpolation circuit that generates an intermediate sample between two adjacent samples based on the values of the two adjacent samples. In other embodiments, additional preceding and/or succeeding values (referred to herein as "taps") may be used, with different taps being given different weights (or filter coefficients). For instance, an 8-tap filter with coefficients of (−2, 8, −21, 79, 79, −21, 8, −2) or a 6-tap filter with coefficients of (2, −14, 76, 76, −14, 2) might be used.

In one embodiment, supersampling unit 314 performs "2× supersampling," in which one intermediate value is generated between each pair of samples, e.g., using an 8-tap filter. In another embodiment, this 2× supersampling operation may be followed by a second 2× supersampling operation (e.g., using a 6-tap filter) to generate two additional intermediate values, resulting in 4× supersampling. In other embodiments, supersampling unit 314 may generate other numbers of intermediate samples, including numbers that are not integer multiples of the input sampling rate. More generally, supersampling unit 314 generates a number M of output samples for every number N of input samples, where M>N; this is referred to herein as M:N supersampling. Any M:N supersampling technique may be employed in supersampling unit 314.

Supersampling unit 314 provides the M:N supersampled data stream to a digital to analog converter (DAC) 316. The supersampled data stream is provided at a supersampling rate, which for M:N supersampling is approximately M/N times the base sampling rate, so that supersampling does not substantially alter the amount of time required to transmit a line or frame of data. DAC 316, which may be of generally conventional design, is configured to convert a received digital signal to a corresponding analog voltage. Thus, DAC 316 generates an analog output signal (which is generally time varying) from the supersampled data.

The analog output signal from DAC 316 is optionally passed through an electromagnetic interference (EMI) filter 318 that attenuates (suppresses) high frequency components of the analog waveform. For example, EMI filter 318 may attenuate all frequencies above about 200 MHz in compliance with FCC regulations limiting high frequency emissions of electronic devices. The filtered output is supplied via a connector 320 to an appropriate display device (e.g., a TV). Connector 320 may be adapted for compatibility with a particular display device or transmission conduit and may be, e.g., a component video connector, an S-video connector, a monitor connector, or other standard connector type.

It will be appreciated that the device described herein is illustrative and that variations and modifications are possible. The various circuit modules may be implemented in a number of ways, and the scanout control logic may include one or more integrated circuit devices. Scanout control logic may also be further integrated with other GPU functions as described above. Additional components for further signal processing may also be provided; for example, the baseband analog output signal from DAC 316 or EMI filter 318 may be mixed onto a carrier wave for wireless (e.g., radio frequency) transmission via a suitable antenna.

Figure 4A:
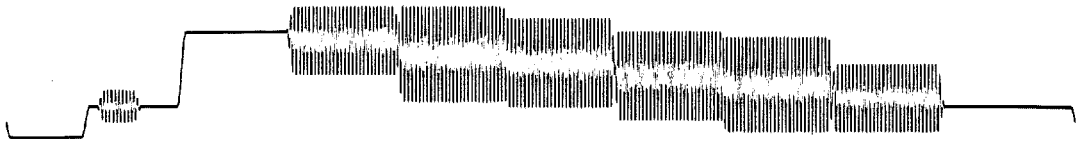
FIG. 4 illustrates an operating principle of the present invention, with FIG. 4A showing a desired analog signal, FIG. 4B showing a frequency decomposition of the signal of FIG. 4A sampled at a nominal rate, FIG. 4C showing a frequency decomposition of the signal of FIG. 4A with 2× supersampling, and FIG. 4D showing a frequency decomposition of the signal of FIG. 4A with 4× supersampling.

Inclusion of M:N supersampling unit 314 in the digital portion of the output path advantageously results in an analog output signal that more closely reflects the target signal. This can reduce, or in some instances eliminate, the need for subsequent analog filtering to correct for such artifacts of the digital-to-analog conversion process as high frequency echoes, spectral response variation from the DAC, and the like. By way of example, FIG. 4 illustrates an operating principle of the present invention. FIG. 4A shows an analog signal formatted for a PAL display device. (This signal represents a series of color bars.) In a conventional digital video processing device, this signal would be generated from pixel color component data by an appropriate encoder, which would produce a series of samples at a base sampling rate, e.g., 54 MS/s; from these samples, the DAC would generate an analog waveform similar to FIG. 4A.

Figure 4B:
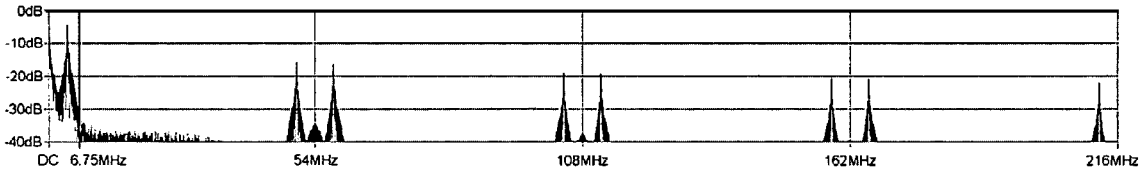

A frequency spectrum of an analog signal that might be generated by the DAC in a conventional device is shown in FIG. 4B. The desired signal is contained in the 0 to 6.75 MHz PAL baseband, but there are also higher frequency echoes in spectral bands near 54 MHz, 108 MHz, etc. These echoes, which are artifacts of digital to analog conversion, are undesirable and would need to be filtered to prevent possible distortion in the displayed image.

Figure 4C:
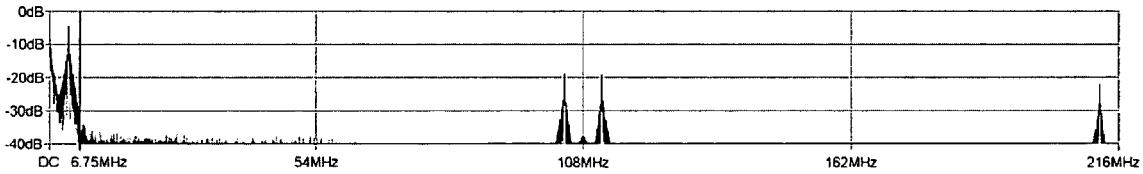

In a video processing device according to one embodiment of the present invention, the encoded digital signal is supersampled prior to conversion to analog, e.g., as shown in FIG. 3. FIG. 4C shows the frequency decomposition of the resulting analog waveform with 2× supersampling (using an 8-tap interpolator), and FIG. 4D shows the frequency decomposition with 4× supersampling (obtained by using an 8-tap interpolator followed by a 6-tap interpolator).

Figure 4D:
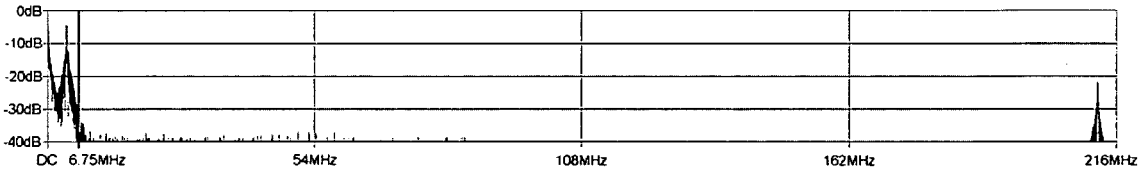

FIGS. 4C and 4D show that embodiments of the present invention provide the desired signal in the 0 to 6.75 MHz baseband, while some of the echoes are suppressed by a factor of about a thousand (30 dB). The intensity of the echoes is attenuated to a level such that the echoes would have no effect (or only a negligible effect) on the displayed image. In FIG. 4C, the first unsuppressed echo appears in a frequency band near 108 MHz, and in FIG. 4D, the first unsuppressed echo appears in a frequency band above 200 MHz. It should be noted that a typical EMI filter would substantially attenuate any frequency components above about 200 MHz, so the first unsuppressed echo in FIG. 4D (as well as any higher frequency echoes) can be effectively eliminated simply by including EMI filter 318. To the extent the echoes below 200 MHz are suppressed by supersampling, analog filtering in the 6.75-200 MHz frequency band is not needed.

Accordingly, the embodiment shown in FIG. 3 can be used to provide a "universal" output path for pixel data, in which analog signals having different formats can be produced using the same circuitry. For instance, encoder 310 may be implemented using a multi-standard encoder that can be configured to generate signal samples at an appropriate base sampling rate for any of a number of different target formats. In one embodiment, encoder 310 has configuration settings for one or more standard definition TV protocols (e.g., NTSC, PAL) and settings for one or more high definition TV protocols (e.g., 480p, 720p, 1080i, etc.). Signals conforming to different ones of these protocols generally have different basebands and different echo bands that should be suppressed. In embodiments of the present invention, echo suppression can be achieved in any desired frequency band by applying appropriate M:N supersampling rather than relying on conventional low pass analog filters that would have to be modified to suppress different frequency bands.

Thus, in some embodiments, it is possible to switch a video processing device to a new target format by modifying one or more configuration parameters of the encoder. In some embodiments, the pixel pipeline may also be configurable to supply pixel data at different rates conforming to the different target formats. It should be noted that the hardware elements of the output path do not need to be changed. In some cases, display devices using different formats may use the same physical connection (e.g., S-video or coaxial cable); in other cases, multiple output connectors may be arranged on the card to provide an additional degree of interchangeability.

Figure 1A:
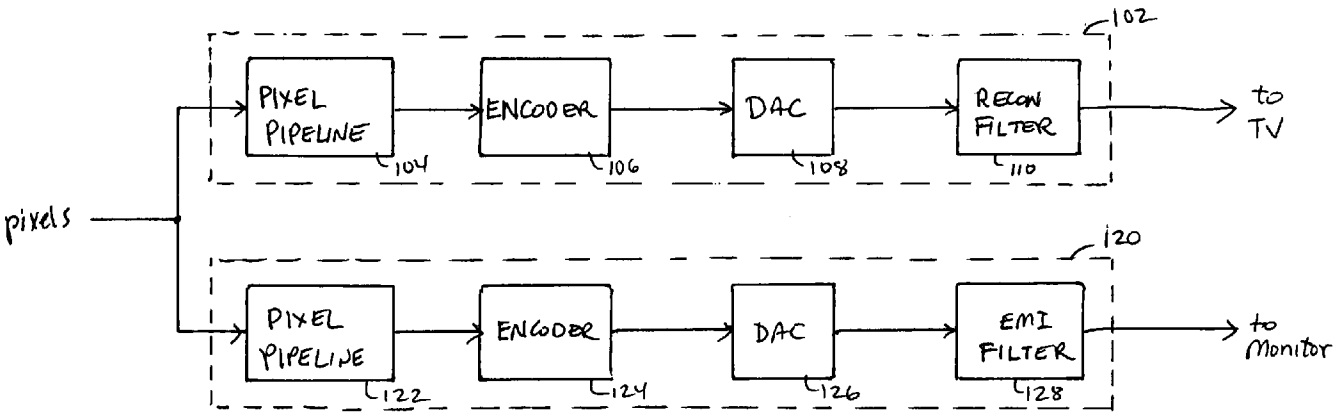
FIG. 1A (Prior Art)
FIGS. 1A-B are block diagrams of video data paths used in conventional video processing devices.
Figure 1B:
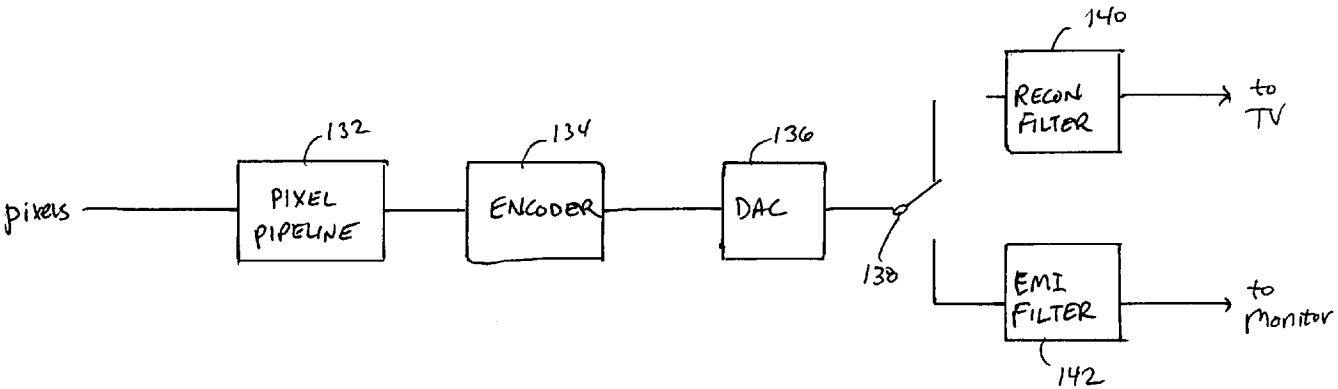
FIG. 1B (Prior Art)

It should also be noted that in some embodiments, reconstructive correction (e.g., sin(x)/x correction) in the analog domain is not needed regardless of the target format. For example, supersampling the DAC input as described herein can significantly reduce frequency dependence in the DAC response, eliminating the need for reconstructive correction. Further, because the same output path can be used for any format, integrated circuits implementing the embodiment shown in FIG. 3 may consume less chip area than conventional multi-format video output paths (e.g., the output paths shown in FIG. 1).

Figure 5:
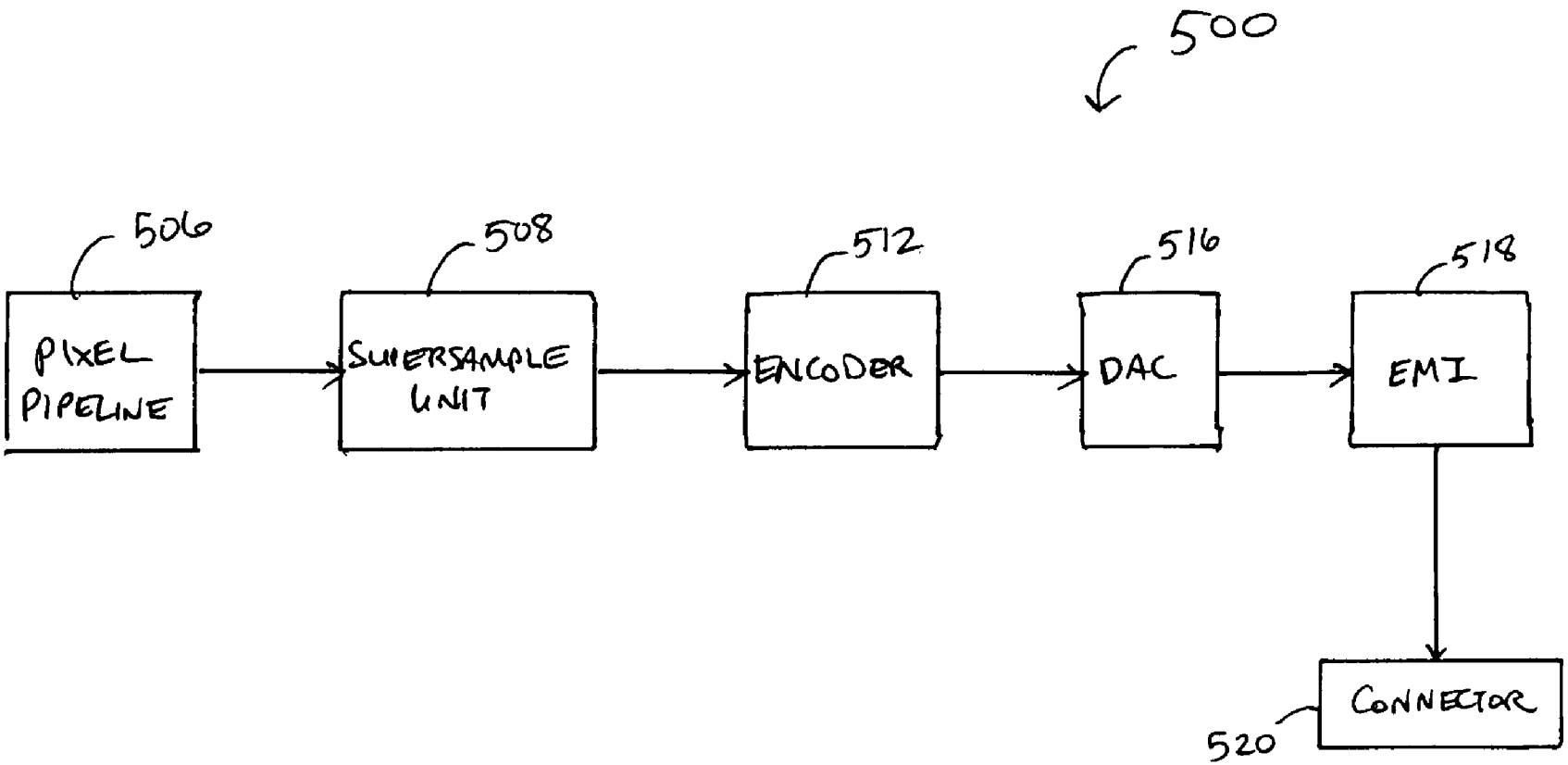
FIG. 5 is a block diagram of a video output path according to an alternative embodiment of the present invention.

FIG. 5 is a block diagram showing an output path 500 for a video processing device according to an alternative embodiment of the present invention. Output path 500 includes a pixel processing pipeline 506 that may be generally similar to pixel processing pipeline 306 described above.

After any transformations in pixel pipeline 506, a stream of digital pixel data is provided to a supersampling (upsampling) unit 508 at a base pixel rate. In this embodiment, supersampling unit 508 increases the number of pixels supplied to the encoder per display line by generating additional pixel values that are intermediate between the pixel values received from pixel pipeline 506. In some embodiments, supersampling unit 508 may include a conventional interpolation circuit that generates an intermediate pixel value between two adjacent input values based on the two adjacent values, and optionally on other preceding and/or succeeding values, including values of adjacent pixels in rows above and/or below the current row. Various pixel interpolation filters known in the art may be used: such filters may have any number of inputs (taps), with different inputs optionally being given different weights, or filter coefficients.

Supersampling unit 508 may generate any number of intermediate pixel values. For instance, 2× supersampling or 4× supersampling may be employed. In one embodiment, 4× supersampling is implemented using two cascaded 2× supersampling operations. In other embodiments, other numbers of intermediate samples may also be generated, including numbers that are non-integer multiples of the input sampling rate. More generally, for every number P of input pixels, supersampling unit 508 generates a number Q of output pixels, where Q>P. A variety of interpolation techniques may be employed in supersampling unit 508, and a detailed description is omitted as not being critical to understanding the present invention.

Supersampling unit 508 provides the supersampled pixel data at a (supersampled) rate of approximately Q/P times the base pixel rate to an encoder 512. Encoder 512 may be generally similar to encoder 310 described above, except that encoder 512 is adapted to receive pixel data the supersampled rate rather than the nominal pixel rate for the target format. As described above, encoder 512 transforms the pixel data (e.g., RGB components) to samples of an analog signal for a particular protocol and may be, e.g., a CVE4 video encoder. In this embodiment, encoder 512 is advantageously configured to receive and process more pixels per line than the target format specifies. Because encoder 512 receives more pixels per line (i.e., a higher density of information) than the target format specifies, encoder 512 can generate a more detailed digital representation of the target analog signal. Thus, echo suppression effects similar to those shown in FIG. 4 can be obtained in this embodiment as well.

Encoder 512 provides the signal samples at an enhanced sampling rate (e.g., at Q/P times a base sampling rate) to a digital to analog converter (DAC) 516. DAC 516, which may be of generally conventional design, is configured to convert a received digital signal to a corresponding analog voltage, similarly to DAC 316 described above. The analog output signal from DAC 516 is optionally passed through an EMI filter 518 for removal of high frequency components. EMI filter 518 may be generally similar to EMI filter 318 described above. The filtered output is supplied via a connector 520 to an appropriate display device (e.g., a TV). Like connector 320, connector 520 is adapted for a particular display device or transmission cable type, and may be, e.g., a component video connector, an S-video connector, a monitor connector, or other standard connector type.

While the invention has been described with respect to specific embodiments, one skilled in the art will recognize that numerous modifications are possible. For instance, digital pixel data may be supplied to the encoder in a number of different formats, including RGB formats and Y/C (luminance/chrominance) formats. The digital pixel data may be generated in various ways, e.g., by executing rendering algorithms for 2-D or 3-D geometry data describing a scene, by decoding MPEG-2 or MPEG-4 video data or other encoded digital video data, and so on. Thus, a GPU or other video processing unit embodying the present invention can be incorporated into a general purpose computing system, a special purpose computing system such as a video game console, a DVD player, or any other system or device for processing digital video data.

Supersampling units, which may operate on target signal sample streams or digital pixel data streams, are not limited to a particular algorithm, number of taps, or filter coefficients, and may generate any larger number of samples for a given number of input samples. The terms "upsampling" and "supersampling" are used interchangeably herein; both terms refer generally to increasing the sampling resolution (e.g., number of data samples per scan line), with sample resolution being measured by the number of pixels per line or analog signal samples per line as appropriate. Cascaded supersampling operations or a sequence of supersampling units may be used to further increase the number of output samples. Various encoders may be used, and the encoder may be adapted to a particular pixel data format and analog output format or configurable for supporting multiple different formats. The supersampling and encoding operations described herein may be implemented in hardware devices, such as one or more application specific integrated circuits (ASICs), in software executing on one or more suitable processors, or any combination thereof. In some embodiments, supersampling and encoding functions may be integrated into a supersampling encoder circuit; such a circuit may encode the data and supersample the encoded data stream, or it may supersample the pixel data and encode the resulting pixel stream.

Thus, although the invention has been described with respect to specific embodiments, it will be appreciated that the invention is intended to cover all modifications and equivalents within the scope of the following claims.

What is claimed is:

1. A device for converting a digital pixel signal to an analog output signal having a target format, the device comprising:

a pixel pipeline circuit configured to provide a pixel stream comprising digital pixel values, wherein the pixel pipeline circuit has an input connected with a digital pixel buffer;

an encoder coupled to an output of the pixel pipeline circuit and having one or more processor elements configured to convert the pixel stream to digital sample values corresponding to a target analog signal representing the pixel stream in the target format, thereby generating a base data stream at a base sampling rate corresponding to the target format;

a supersampling circuit coupled to an output of the encoder and configured to generate a supersampled data stream at a supersampling rate from the base data stream, the supersampling rate being higher than the base sampling rate; and a digital to analog converter coupled to an output of the supersampling circuit and configured to convert the supersampled data stream to the analog output signal having the target format with the base sampling rate.

2. The device of claim 1, wherein the supersampling rate is selected so as to provide substantial attenuation of a higher frequency echo in the analog output signal, the higher frequency echo occurring in a frequency band above a baseband of the analog output signal.

3. The device of claim 2, further comprising an electromagnetic interference (EMI) filter coupled to an output of the digital to analog converter and configured to substantially attenuate frequency components of the analog output signal above a maximum frequency.

4. The device of claim 3, wherein the supersampling rate is selected so as to substantially attenuate an echo of the analog output signal, the echo appearing in a frequency band between a baseband of the analog signal and the maximum frequency.

5. The device of claim 2, wherein the baseband of the analog output signal is determined with reference to a baseband for a standard definition television monitor.

6. The device of claim 2, wherein the baseband of the analog output signal is determined with reference to a baseband for a high definition television monitor.

7. The device of claim 1, wherein the encoder is further configured to respond to one or more control parameters, thereby enabling selection of one of a plurality of candidate formats as the target format.

8. The device of claim 7, wherein the plurality of candidate formats includes a standard definition television format and a high definition television format.

9. The device of claim 1, wherein the supersampling rate is substantially equal to twice the base sampling rate.

10. The device of claim 1, wherein the supersampling rate is substantially equal to four times the base sampling rate.

11. A device for converting a digital pixel signal to an analog output signal having a target format, the device comprising:

a pixel pipeline circuit configured to provide a pixel stream comprising a first number of digital pixel values per line at a base pixel rate, wherein the pixel pipeline circuit has an input connected with a digital pixel buffer;

a supersampling circuit coupled to an output of the pixel pipeline circuit and configured to generate a supersampled pixel stream comprising a second number of digital pixel values per line, the second number being greater than the first number, at a supersampling rate higher than the base pixel rate;

an encoder coupled to an output of the supersampling circuit and having one or more processor elements configured to convert the supersampled pixel stream to digital sample values for a target analog signal representing the supersampled pixel stream in the target format, thereby generating a supersampled data stream at an enhanced sampling rate; and a digital to analog converter coupled to an output of the encoder and configured to convert the supersampled data stream to an analog output signal having the target format, wherein the sampling rate of the analog output signal having the target format is less than the enhanced sampling rate of the supersampled data stream.

12. The device of claim 11, wherein the supersampling rate is selected so as to provide substantial attenuation of a higher frequency echo of the analog output signal, the higher frequency echo occurring in a frequency band above a baseband of the analog output signal.

13. The device of claim 12, further comprising an electromagnetic interference (EMI) filter coupled to an output of the digital to analog converter and configured to substantially attenuate all frequencies of the analog output signal greater than a maximum frequency.

14. The device of claim 13, wherein the supersampling rate is selected so as to substantially attenuate an echo of the analog output signal, the echo appearing in a frequency band between a baseband of the analog signal and the maximum frequency.

15. The device of claim 11, wherein the encoder is further configured to respond to one or more control parameters, thereby enabling selection of one of a plurality of candidate formats as the target format.

16. The device of claim 15, wherein the plurality of candidate formats includes a standard definition television format and a high definition television format.

17. A video processing unit comprising:

a pixel generator circuit configured to generate and store, in a pixel buffer, digital pixel data for a frame of an image;

a pixel pipeline configured to retrieve the stored pixel data from the pixel buffer and to provide a pixel stream comprising digital pixel values at a base pixel rate;

an encoder coupled to an output of the pixel pipeline and having one or more processor elements configured to convert the pixel stream to digital sample values for a target analog signal representing the pixel stream in a target format, thereby generating a base data stream at a base sampling rate;

a supersampling circuit coupled to an output of the encoder and configured to generate a supersampled data stream at a supersampling rate from the base data stream, the supersampling rate being higher than the base sampling rate; and a digital to analog converter coupled to an output of the supersampling circuit and configured to convert the supersampled data stream to an analog output signal in the target format, wherein the sampling rate of the analog output signal having the target format is less than the supersampling rate of the supersampled data stream, wherein the supersampling rate is selected so as to provide substantial attenuation of a higher frequency echo in the analog output signal, the higher frequency echo occurring in a frequency band above a baseband of the analog output signal.

18. The video processing unit of claim 17, wherein the encoder is further configured to respond to one or more control parameters, thereby enabling selection of one of a plurality of candidate formats as the target format.

19. The device of claim 18, wherein the plurality of candidate formats includes a standard definition television format and a high definition television format.

20. A method for converting a digital pixel signal to an analog output signal having a target format, the method comprising:

receiving, at a pixel pipeline circuit, a first pixel stream comprising digital pixel values from a pixel buffer;

transforming the digital pixel values with the pixel pipeline circuit configured to provide a second pixel stream comprising digital pixel values;

encoding, with an encoder having one or more processor elements, the second pixel stream as a base data stream comprising digital sample values for a corresponding analog signal having the target format, wherein the encoding is performed at a base sampling rate;

supersampling the base data stream at a supersampling rate, the supersampling rate being higher than the base sampling rate, thereby generating a supersampled data stream; and converting the supersampled data stream to an analog output signal having the target format, wherein the sampling rate of the analog output signal having the target format is less than the supersampling rate of the supersampled data stream, wherein the supersampling rate is selected so as to provide substantial attenuation of a higher frequency echo in the analog output signal, the higher frequency echo occurring in a frequency band above a baseband of the analog output signal.

21. The method of claim 20, further comprising:

selecting the target format from a plurality of candidate formats.

22. The method of claim 21, wherein the plurality of candidate formats includes a standard definition television format and a high definition television format.

* * * * *